US005926971A

United States Patent [19]

Chau-Huu et al.

[11] Patent Number: 5,926,971

[45] Date of Patent: Jul. 27, 1999

[54] MACHINE FOR PRODUCING A MATERIAL WEB

[75] Inventors: Tri Chau-Huu, Heidenheim; Markus Oechsle, Bartholomä; Albrecht Meinecke, Heidenheim, all of Germany

[73] Assignee: Voith Sulzer Papiermaschinen GmbH, Heidenheim, Germany

[21] Appl. No.: 08/856,186

[22] Filed: May 14, 1997

[30] Foreign Application Priority Data

May 15, 1996 [DE] Germany ..... 196 19 531

[51] Int. Cl.[6] ..... D21F 5/00

[52] U.S. Cl. ..... 34/117; 34/119; 34/123; 34/124

[58] Field of Search ..... 34/111, 116, 117, 34/119, 120, 123, 124; 162/206, 207

[56] References Cited

U.S. PATENT DOCUMENTS

| | | | |
|---|---|---|---|
| 3,503,139 | 3/1970 | Mahoney | 34/111 |
| 3,925,906 | 12/1975 | Chance et al. | 34/422 |
| 4,461,095 | 7/1984 | Lehtinen et al. | 34/392 |
| 4,622,758 | 11/1986 | Lehtinen et al. | 34/392 |
| 5,291,666 | 3/1994 | Babinsky et al. | 34/425 |
| 5,572,801 | 11/1996 | Ahokas et al. | 34/117 |
| 5,649,371 | 7/1997 | Loser et al. | 34/111 |
| 5,799,409 | 9/1998 | Chau-Huu et al. | 34/117 |
| 5,813,136 | 9/1998 | Meschenmoser | 34/446 |

FOREIGN PATENT DOCUMENTS

| | | |
|---|---|---|
| 1260700 | 9/1989 | Canada . |
| 3520070 | 12/1985 | Germany . |
| 3532853 | 4/1986 | Germany . |

*Primary Examiner*—Henry Bennett
*Assistant Examiner*—Pamela A. Wilson
*Attorney, Agent, or Firm*—Greenblum & Bernstein P.L.C.

[57] ABSTRACT

Machine for producing a material web, e.g., paper or cardboard, that may include a dryer section with at least one dryer group and the at least one dryer group may have at least one dryer cylinder, a dryer screen, and a metal belt. The machine may also include a cooling device associated with the metal belt. The material web, the dryer screen and the metal belt may be guided in a meandering path around an outside of the at least one dryer cylinder, and the dryer screen may be positioned between the material web and the metal belt. Further, at least one of the metal belt and the dryer screen may be intensely prestressed.

20 Claims, 1 Drawing Sheet

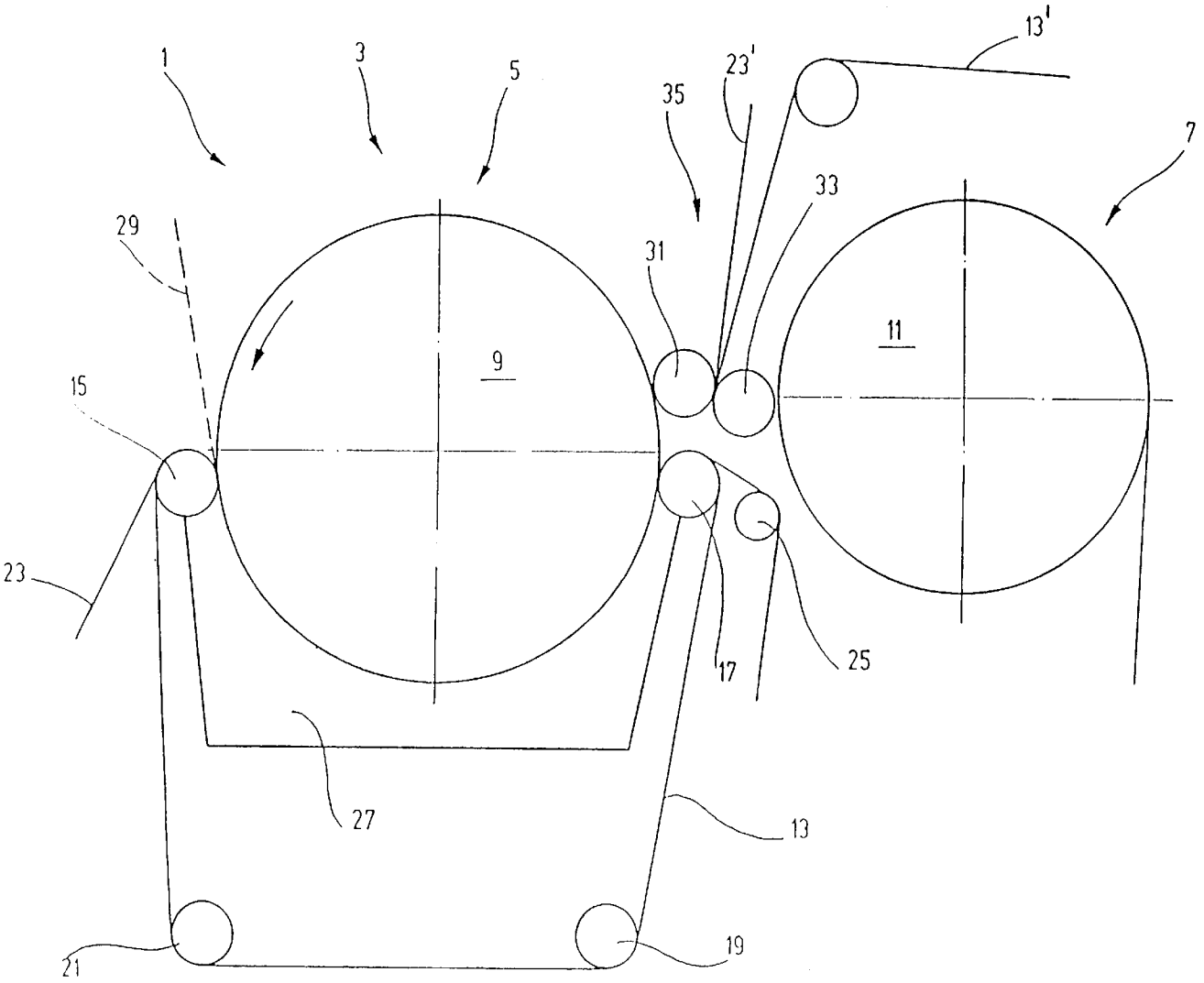
7
13'
11
33
23'
35
31
25
17
13
19
5
9
3
1
29
15
23
27
21

MACHINE FOR PRODUCING A MATERIAL WEB

CROSS-REFERENCE OF RELATED APPLICATION

The present invention claims the priority under 35 U.S.C. § 119 of German Patent Application No. 196 19 531.4 filed on May 15, 1996, the disclosure of which is expressly incorporated by reference herein in its entirety.

BACKGROUND OF THE INVENTION

1. Field of the Invention

The present invention relates to a machine for producing a material web, e.g., a paper or cardboard web. The machine may include a dryer section with at least one dryer group having at least one dryer cylinder. The material web may be guided along a meandering or winding path around the dryer cylinder with a dryer screen and a metal belt. At least one of the metal belt, which may be guided around an outside of the dryer cylinder, and the dryer screen, which may be disposed between the material web and the metal belt, may be intensely prestressed against the material web and the dryer cylinder. A cooling device may be associated with the metal belt.

2. Discussion of the Background Information

A machine similar in general to the above-mentioned type of machine has been disclosed in U.S. Pat. No. 5,291,666. The machine includes a dryer section with a dryer group. Inside the dryer group, at least one heated dryer cylinder is provided. A web is disposed between a dryer screen and a metal belt and is guided along with them around the dryer cylinder. In a dryer of this kind, it is disadvantageous that a fluid emerging from the web is not sufficiently absorbed by the dryer screen. This drawback further reduces the drainage capacity of the dryer group or the dryer section. To overcome the above-noted deficiencies, additional and/or enlarged dryer groups must be provided and utilized in these types of machines. This unfortunately leads to an increased overall length of the machine, and considerably increased manufacture costs.

SUMMARY OF THE INVENTION

An object of the present invention, therefore, may be to produce a machine whose dryer section exhibits an increased dryer and drainage capacity without correspondingly increasing the overall length of the dryer section.

The above object may be achieved with a machine that includes a dryer section with at least one dryer group having at least one dryer cylinder. A material web may be guided, with a dryer screen and a metal belt, along a meandering or winding path around the dryer cylinder. The metal belt, which may be positioned around an outer surface of the dryer cylinder, and/or the dryer screen, which may be positioned between the material web and the metal belt, may be intensely prestressed against the dryer cylinder. Further, a cooling device may be associated with the metal belt. As a result of the intense prestressing of the metal belt and/or the dryer screen, stationary compressive forces may act perpendicular to a surface of the material web and, therefore, press the material web against the outer circumference of the dryer cylinder. By increasing the pressure holding the material web against the heated surface of the dryer cylinder, the transfer of heat to the material web, and within the material web, increases. This increased heat transfer, increases a discharge rate of a fluid bound within the material web. By cooling the metal belt with the cooling device, a temperature difference between the heated dryer cylinder in the direction of the metal belt becomes apparent. The temperature difference increases a heat flux and enables a discharge direction of the fluid leaving the material web in the form of vapor to be adjusted. The fluid, e.g., may emerge on a side of the material web oriented toward the dryer screen. Immediately after emerging from the material web, the fluid may condense on the dryer screen and may be absorbed by the dryer screen. The drying process may be additionally enhanced by the dryer screen resting on or abutting the relatively cool metal belt, thereby cooling a contacting surface of the dryer screen and giving off a part of its absorbed or stored heat. The dryer section may include a very high drainage capacity and a high drying rate so that additional or larger dryer groups are not necessary.

A preferred embodiment of the present invention, the machine may include a cooling device that cools the metal belt in a region in which the metal belt is guided around the dryer cylinder. As a result, a particularly high temperature difference may become apparent between the heated dryer cylinder and the cooled metal belt. This may result in a particularly high heat flux and, consequently, in an increased drying rate.

In another preferred embodiment of the present invention, the cooling device may include a suction box, a blow box, or a suction/blow box. In this manner, air, which may be aspirated from the machine environment at no cost, may be utilized as a cooling medium. Further, no closed, cost-intensive cooling loop is necessary.

According to a further embodiment of the present invention, the prestressing of the metal belt and/or the dryer screen may be adjusted so that a surface pressure of between, e.g., approximately 10 kPa to 100 kPa is produced on the dryer cylinder.

The present invention may be directed to a machine for producing a material web. The machine may include a dryer section with at least one dryer group and the at least one dryer group may have at least one dryer cylinder, a dryer screen, and a metal belt. The machine may also include a cooling device associated with the metal belt. The material web, the dryer screen and the metal belt may be guided in a meandering path around an outside of the at least one dryer cylinder, and the dryer screen may be positioned between the material web and the metal belt. Further, at least one of the metal belt and the dryer screen may be intensely prestressed.

According to another feature of the present invention, the cooling device may cool the metal belt in a region in which the metal belt is guided around the dryer cylinder.

According to another feature of the present invention, the cooling device may include one of a suction box, a blow box, and a suction/blow box.

According to still another feature of the present invention, the prestressing of the at least one of the metal belt and the dryer screen against the dryer cylinder may be adjusted to produce a surface pressure of between approximately 10 kPa to 100 kPa According to a further feature of the present invention, the material web may include one of a paper web and a cardboard web.

The present invention may also be directed to a dryer section in a material web producing machine. The dryer section may include at least one dryer group including at least one dryer cylinder, a device for pressing at least one of a metal belt and a dryer screen against the at least one dryer cylinder, and a cooling device for effecting heat transport from the dryer cylinder to the at least one of the metal belt and the dryer screen.

According to another feature of the present invention, the dryer section may also include a dryer screen and a metal belt. The metal belt and the dryer screen may be guided around a portion of an outer circumference of the at least one dryer cylinder, such that the dryer screen may be positioned between the metal belt and the dryer cylinder. Further, the pressing device may exert a predetermined pressure against the portion of the outer circumference of the at least one dryer cylinder, and the cooling device may be positioned adjacent the metal belt. The predetermined pressure may be greater than 4 kPa.

According to a further feature of the present invention, the dryer section may also include at least a first dryer group and a second dryer group, and a transition region between the at least first and second dryer groups. In the transition region, a plurality of deflection rolls may be adapted for lifting off a material web from the first dryer group, for guiding the material web to the second dryer group, and for drying an opposite side of the material web.

According to a still further feature of the present invention, the cooling device may maintain the metal belt at a temperature below a temperature of the at least one dryer cylinder. The temperature of the metal belt may be maintained at between approximately 100° C. and 200° C. and the temperature of the at least one dryer cylinder may be maintained at between 150° and 300° C.

According to a further feature of the present invention, the metal belt may cool a portion of the dryer screen.

According to a still further feature of the present invention, the metal belt may be adapted to draw a fluid discharge flow from the material web. Further, the fluid discharge may condense on and may be absorbed by the dryer screen.

According to still another feature of the present invention, the pressing device may exert a compressive force perpendicular to a surface of the dryer cylinder.

The present invention may also be directed to a dryer section for a material web producing machine that includes a first dryer group having a first dryer cylinder, a first metal belt, and a first dryer screen, and a second dryer group having a second dryer cylinder, a second metal belt, and a second dryer screen. The first metal belt and the first dryer screen may be adapted for guiding a first side of a material web around the first dryer cylinder, and the second metal belt and the second dryer screen may be adapted for guiding a second side of the material web around the second dryer cylinder. At least one of the first metal belt and the first dryer screen may exert a first predetermined pressure against the first dryer cylinder, and at least one of the second metal belt and the second dryer screen may exert a second predetermined pressure against the second dryer cylinder. Further, at least one cooling device may be associated with at least one of the first metal belt and the second metal belt.

According to another feature of the present invention, the cooling device may include one of a suction box, a blow box, and a suction/blow box.

According to yet another feature of the present invention, each metal belt may be positioned to cool at least a portion of each dryer screen, each dryer screen may be adapted to absorb a fluid emerging from the material web, and each dryer cylinder may be maintained at a temperature greater than a temperature of the metal belt.

Other exemplary embodiments and advantages of the present invention may be ascertained by reviewing the present disclosure and the accompanying drawing.

BRIEF DESCRIPTION OF THE DRAWINGS

The present invention may be further described in the detailed description which follows, with reference to the noted drawing FIGURE illustrating an example of a preferred embodiment of the present invention, and wherein:

The FIGURE illustrates a portion of a dryer section located between two dryer groups.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing FIGURE making apparent to those skilled in the art how the invention may be embodied in practice.

The machine illustrated in the FIGURE may be generally utilized in producing material webs of various types and compositions. While the present invention is generally described in terms of paper webs, it is understood that no limitation is intended or should be construed.

The FIGURE illustrates a portion of a paper making machine 1, and more particularly a dryer section 3 of paper machine 1, which is shown in a schematic side view. Dryer section 3 may include at least one dryer group, and, in the exemplary embodiment, two dryer groups 5 and 7 have been illustrated. Dryer group 5 may include at least one dryer cylinder, and dryer cylinder 9 may be the last dryer cylinder of dryer group 5. Further, dryer group 7 may also include at least one dryer cylinder, and dryer cylinder 11 may be the first dryer cylinder of dryer group 7.

Dryer group 5 may also include a metal belt 13 that may be guided, e.g., in a closed loop, by a plurality of deflection rolls 15, 17, 19, and 21 so that a portion of metal belt 13 may rest against or along an outer circumference or surface of dryer cylinder 9 over a predetermined angular range, e.g., approximately 180°. At deflection roll 15, a dryer screen (or felt) 23 may be guided around dryer cylinder 9 while resting on metal belt 13. At deflection roll 17, dryer screen 23 may be further deflected by a deflection roll 25 and may be returned to a beginning of dryer group 5 or to deflection roll 15.

A cooling device 27, e.g., a suction/blow box, or, alternatively, a suction box or a blow box, may be positioned inside a loop formed by the path of metal belt 13 to cool metal belt 13 in a region in which metal belt 13 is positioned around the outside or outer surface of dryer cylinder 9. Thus, cooling device 27 may be positioned to cool metal belt 13 with ambient air flow, e.g., by blowing or by suctioning. Cooling device 27 may be arranged adjacent to the portion of metal belt 13 that is positioned or guided around heated dryer cylinder 9. The cooling of metal belt 13 creates a temperature difference between the heated surface of dryer cylinder 9 and a facing surface of metal belt 13, through which material web 29 and dryer screen 23 are guided.

Material web 29 may be removed from or lifted off dryer cylinder 9 in a transition region 35 between dryer groups 5 and 7 by deflection rolls 31 and 33. Material web 29 may then be supplied or guided to dryer cylinder 11 of dryer group 7. In the transfer of material web 29 depicted in the FIGURE, alternate sides of material web 29 may be dried. In dryer group 7, a dryer screen 23' and a metal belt 13' may be guided onto a deflection roll 33. Material web 29, from deflection roll 31, may be guided onto metal belt 13' and dryer screen 23' around deflection roll 33, and may be held against the outer surface of dryer cylinder 11 to effect drying of an opposite side of material web 29. The arrangement of dryer group 7 is substantially mirror-inverted to the arrangement depicted and discussed with respect to dryer group 5. Further, while not shown, dryer group 7 also include a cooling device for cooling metal belt 13'.

In the region of deflection roll 15, material web 29 may be guided, with dryer screen 23 and metal belt 13, onto a heated outer surface of dryer cylinder 9. While being guided around dryer cylinder 9, dryer screen 23 may be positioned between material web 29 and metal belt 13. Because of a high prestressing of dryer screen 23 and/or metal belt 13, material web 29 may be pressed against the outer surface or circumference of dryer cylinder 9 with a predetermined force. In this manner, material web 29 may be compressed, i.e., similar to as in a pressing device, and the heat transport or transfer inside material web 29, i.e., in a direction from the heated surface of dryer cylinder 9 toward cooling device 27, may be increased. Further, the heat transport due to the high temperature difference between the heated surface of dryer cylinder 9 in the direction of the cooled metal belt 13 may also be improved. Fluid, which may emerge from material web 29 as vapor in the direction of the temperature difference, may condense on dryer screen 23 and may be absorbed by it. Thus, an optimal dewatering of material web 29 may be produced and a discharge of fluid from the drying region occurs. In dryer group 7, which, as noted above, is substantially a mirror-inverted version of dryer group 5, material web 29 may be dewatered and dried in a substantially identical manner to that described above for dryer group 5. However, in passing through dryer group 7, a side of material web 29, opposite the side that contacted the heated surface of dryer cylinder 9, may contact the heated surface of dryer cylinder 11.

In addition to the increased fluid discharge and heat transport, compression of material web 29 by a pressing force exerted on material web 29 against the outer surface dryer cylinders 9 and 11 may lead to an evening out of the material web properties. Thus, a qualitative improvement of material web 29 may result. A quality increase may also become apparent by the fact that the drying of material web 29 occurs while material web 29 is held against dryer cylinder 9 (or 11) by at least one of dryer screen 23 and metal belt 13 (or at least one of dryer screen 23' and metal belt 13'). By holding material web during the drying, free shrinkage of material web 29 may be substantially prevented. A surface pressure exerted on material web 29 against dryer cylinder 9 (11) may be adjusted by prestressing at least one of metal belt 13 (13') and dryer screen 23 (23') and may be, e.g., between approximately 10 kPa to 100 kPa. The pressure amounts utilized in the present invention may be significantly greater than, i.e., multiples of, those amounts used in the prior art which were typically between 2 kPa to 4 kPa Dryer cylinders 9 and 11 may be heated, e.g., with steam, and may exhibit temperatures on their outer surfaces from, e.g., between approximately 150° C. to 300° C. Cooling device 27, which may be a suction box, a blow box, or a suction/blow box, may acid on metal belt 13 with a current of air. The air current, which has a temperature lower than the temperature prevailing on the outer surface of dryer cylinder 9, may have a temperature of, e.g., between approximately 100° C. to 200° C.

Under the high pressure exerted on the material web against the dryer cylinder and under the influence of the high temperature of the dryer cylinder, a material web exhibiting very high strength properties may be produced. These properties may be based upon a softening of the lignin and hemicellulose present in the material web and upon an increased number of fiber bonding points.

As depicted in the FIGURE, dryer cylinder 9 of dryer group 5 is shown to have a larger diameter than that of dryer cylinder 11 of dryer group 7. However, the FIGURE is intended for purposes of explanation and is no way intended as limiting. For example, the present invention also contemplates utilizing dryer cylinders with a same diameter, e.g., within a range between approximately 1.5 m to 5.0 m, and preferably approximately 2.2 m.

From the foregoing, it becomes apparent that, because of the high surface pressure exerted of the material web, because of the adjustment of the high temperature difference, and because of the optimized discharge of the fluid emerging from the material web by the dryer screen, a dryer section may be produced that includes a high drainage capacity and high drying values and/or rates. A powerful drying section of the kind discussed above may have a very short length in comparison to conventional dryer sections of the prior art, and, thus, an overall length of the machine for producing the material web may be likewise reduced.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A machine for producing a material web comprising:

a dryer section including at least one dryer group;

the at least one dryer group including at least one dryer cylinder, a dryer screen, and a metal belt; and a cooling device associated with the metal belt, wherein the material web, the dryer screen and the metal belt are guided in a meandering path around an outside of the at least one dryer cylinder, and the dryer screen is positioned between the material web and the metal belt, and wherein at least one of the metal belt and the dryer screen is intensely prestressed.

2. The machine according to claim 1, the cooling device cools the metal belt in a region in which the metal belt is guided around the dryer cylinder.

3. The machine according to claim 1, the cooling device comprising one of a suction box, a blow box, and a suction/blow box.

4. The machine according to claim 1, wherein the prestressing of the at least one of the metal belt and the dryer screen is adjusted to produce a surface pressure of between approximately 10 kPa to 100 kPa against the dryer cylinder.

5. The machine according to claim 1, wherein the material web comprises one of a paper web and a cardboard web.

6. A dryer section in a material web producing machine comprising:

at least one dryer group including at least one dryer cylinder;

a device for pressing at least one of a metal belt and a dryer screen against the at least one dryer cylinder; and a cooling device for effecting heat transport from the dryer cylinder to the at least one of the metal belt and the dryer screen.

7. The dryer section according to claim 6, further comprising a dryer screen; and a metal belt, wherein the metal belt and the dryer screen are guided around a portion of an outer circumference of the at least one dryer cylinder, such that the dryer screen is positioned between the metal belt and the dryer cylinder.

8. The dryer section according to claim 7, wherein the pressing device exerts a predetermined pressure against the portion of the outer circumference of the at least one dryer cylinder, and wherein the cooling device is positioned adjacent the metal belt.

9. The dryer section according to claim 8, wherein the predetermined pressure is greater than 4 kPa.

10. The dryer section according to claim 6, further comprising at least a first dryer group and a second dryer group;

a transition region between the at least first and second dryer groups, wherein, in the transition region, a plurality of deflection rolls are adapted for lifting off a material web from the first dryer group, for guiding the material web to the second dryer group, and for drying an opposite side of the material web.

11. The dryer section according to claim 6, further comprising:

a metal belt; and a dryer screen.

12. The dryer section according to claim 11, wherein the cooling device maintains the metal belt at a temperature below a temperature of the at least one dryer cylinder.

13. The dryer section according to claim 12, wherein the temperature of the metal belt is maintained at between approximately 100° C. and 200° C., and wherein the temperature of the at least one dryer cylinder is maintained at between 150° C. and 300° C.

14. The dryer section according to claim 12, wherein the metal belt cools a portion of the dryer screen.

15. The dryer section according to claim 12, wherein the metal belt is adapted to draw a fluid discharge flow from the material web.

16. The dryer section according to claim 15, wherein the fluid discharge condenses on and is absorbed by the dryer screen.

17. The dryer section according to claim 6, wherein the pressing device exerts a compressive force perpendicular to a surface of the material web.

18. A dryer section for a material web producing machine comprising:

a first dryer group comprising a first dryer cylinder, a first metal belt, and a first dryer screen;

a second dryer group comprising a second dryer cylinder, a second metal belt, and a second dryer screen;

the first metal belt and the first dryer screen adapted for guiding a first side of a material web around the first dryer cylinder;

the second metal belt and the second dryer screen adapted for guiding a second side of the material web around the second dryer cylinder;

at least one of the first metal belt and the first dryer screen exerting a first predetermined pressure web against the first dryer cylinder;

at least one of the second metal belt and the second dryer screen exerting a second predetermined pressure against the second dryer cylinder; and at least one cooling device associated with at least one of the first metal belt and the second metal belt.

19. The dryer section according to claim 18, the cooling device comprising one of a suction box, a blow box, and a suction/blow box.

20. The dryer section according to claim 18, wherein each metal belt is positioned to cool at least a portion of each dryer screen, each dryer screen is adapted to absorb a fluid emerging from the material web, and each dryer cylinder is maintained at a temperature greater than a temperature of the metal belt.

* * * * *